United States Patent [19]

Würfel et al.

[11] Patent Number: 4,643,371

[45] Date of Patent: Feb. 17, 1987

[54] APPARATUS FOR UNWINDING EXPOSED ROLL FILMS FROM REELS

[75] Inventors: Reinhart Würfel, Munich; Helmut Zangenfeind, Puchheim; Günther Dömges, Deisenhofen; Raimund Kugel, Munich, all of Fed. Rep. of Germany

[73] Assignee: Agfa-Gevaert Aktiengesellschaft, Leverkusen, Fed. Rep. of Germany

[21] Appl. No.: 778,611

[22] Filed: Sep. 20, 1985

[30] Foreign Application Priority Data

Oct. 9, 1984 [DE] Fed. Rep. of Germany ..... 3437068

[51] Int. Cl.[4] ..... G03D 13/00

[52] U.S. Cl. ..... 242/55; 242/65; 242/58.1; 242/58.6

[58] Field of Search ..... 354/76, 173.1, 275; 242/55, 58.1, 58.6, 65; 29/806, 426.3

[56] References Cited

U.S. PATENT DOCUMENTS

| | | | |
|---|---|---|---|
| 3,823,888 | 7/1974 | Zangenfeind et al. | 242/55 |
| 3,883,054 | 5/1975 | Butschek | 242/55 X |
| 3,921,278 | 11/1975 | Basu | 242/55 X |
| 4,564,999 | 1/1986 | Uchiyama et al. | 242/55 X |

*Primary Examiner*—Stuart S. Levy
*Assistant Examiner*—David Werner
*Attorney, Agent, or Firm*—Peter K. Kontler

[57] ABSTRACT

Apparatus for unwinding exposed customer roll films from reels immediately upon expulsion of reels from their cartridges has a composite housing which can be opened up at an unwinding station to receive a reel in the open position and to thereupon close preparatory to unwinding of the film by means of a friction wheel which is movable sideways into engagement with the outermost film convolution between the flanges of the reel at the unwinding station. A stripping device is adjacent to the inlet of a channel which is defined for the roll film by the housing in closed position, and the stripping device engages and directs the leader of the film into the channel as soon as the reel starts to rotate under the action of the friction wheel. The friction wheel and the stripping device are disposed diametrically opposite each other, and the length of the housing is less than the distance between the flanges of the reel at the unwinding station. The support for the core of the reel at the unwinding station is disengaged from the reel when the housing is closed and before the reel is driven in a direction to pay out the film.

21 Claims, 6 Drawing Figures

APPARATUS FOR UNWINDING EXPOSED ROLL FILMS FROM REELS

CROSS-REFERENCE TO RELATED APPLICATIONS

The apparatus of the present invention is in part identical with those disclosed in commonly owned copending patent application Ser. Nos. 778,609 and 778,612 filed Sept. 20, 1985.

BACKGROUND OF THE INVENTION

The present invention relates to improvements in apparatus for unwinding elongated strips or webs of flexible material from the cores of reels. More particularly, the invention relates to improvements in apparatus for unwinding elongated customer roll films from the cores of reels which are expelled from the shells of cartridges or analogous containers for photographic film.

U.S. Pat. No. 3,921,278 discloses an apparatus wherein a flexible endless band is caused to engage more than one-half of the outermost convolution of a roll of exposed photographic film on the core of a reel. The band is driven in a direction to unwind the film from the core and cooperates with a yieldably mounted or resilient tongue serving to divert the leader of the film from the adjacent convolution and to direct the diverted leader into a channel for advancement to a splicing station where the leader is attached to the trailing end of the previously unwound roll film. The end portions of the core of the reel are held between two coaxial bolts or between two rotary shafts so that the diverting finger must move toward the axis of the core as the diameter of the roll of film on the reel decreases as well as when a reel carrying a largerdiameter roll of exposed film is followed by a reel which carries a smaller-diameter roll. The two shafts or bolts are retracted to release the core therebetween only when the unwinding operation is completed. This reduces the output of such unwinding apparatus because the bolts or shafts can engage the next-following core only when the preceding reel is removed from the unwinding station, i.e., when the unwinding of the entire roll of film from the preceding reel is completed.

OBJECTS AND SUMMARY OF THE INVENTION

An object of the invention is to provide an apparatus which can process a large number of reels with convoluted roll films per unit of time.

Another object of the invention is to provide an apparatus which can reliably remove or unwind the convoluted roll film from its core in a time-saving operation and in a fully automatic way.

A further object of the invention is to provide the apparatus with novel and improved means for confining the reel and the roll film thereon at the unwinding station.

Still another object of the invention is to provide an apparatus which can be integrated into a production line with automatic reel expelling apparatus and with automatic apparatus for splicing successively unwound films end-to-end to form an elongated web or strip which is ready to be introduced into a developing machine.

Another object of the invention is to provide an apparatus whose output greatly exceeds the output of conventional apparatus but which is at least as reliable as heretofore known unwinding apparatus.

A further object of the invention is to provide the unwinding apparatus with novel and improved means for diverting the leader of the roll of convoluted film into a prescribed path as well as with novel and improved means for separating the trailing end of the unwound roll of film from the core of the respective reel.

An additional object of the invention is to provide the apparatus with novel and improved means for supporting the core of the reel preparatory to engagement of roll film by the unwinding instrumentalities.

Another object of the invention is to provide the apparatus with novel and improved means for initiating a sequence of operations so as to ensure rapid, reliable and predictable unwinding and further processing of successive roll films at frequent intervals.

The invention is embodied in an apparatus for unwinding photographic roll films from successive reels of the type wherein a roll of exposed customer film is convoluted around a core between two spaced-apart flanges. The apparatus comprises means (e.g., an axially movable mandrel and an axially movable pusher) for releasably supporting the cores of successive reels in a predetermined orientation (e.g., in such a way that the axis of the core is horizontal) at an unwinding station, means (e.g., two fluid-operated motors) for disengaging the supporting means from the core of the reel at the unwinding station, a composite housing which is provided at the unwinding station and comprises a plurality of sections including at least one mobile section and means for moving the one section between an operative position in which the sections together define a chamber for the roll of film on the core of the reel at the unwinding station and a channel having an inlet in communication with the chamber, and an inoperative position in which the reel can be removed from the housing (preferably by way of the channel whose width increases in response to movement of the one section to the inoperative position), and a friction wheel or other suitable means for rotating the roll of film at the unwinding station in the operative position of the one section and in a direction to unwind the film and to cause entry of the leader of such film into the channel.

The housing preferably comprises a stripping device which is adjacent to the inlet of the channel and serves to direct the leader of the film in the chamber into the channel in response to rotation of the roll of film in the chamber in a direction to unwind the film from the core. The rotating means and the stripping device are preferably located at least substantially diametrically opposite each other with reference to the roll of film in the chamber. The length of the chamber, as considered in the axial direction of the reel at the unwinding station, is preferably less than the distance between the flanges of a reel so that the housing can engage the outermost convolution of roll film in the space between the flanges. The disengaging means is actuatable (e.g., in response to movement of the one section to its operative position) to disengage the supporting means from the core of the reel at the unwinding station prior to unwinding of the film from the core by way of the rotating means.

The internal surface of the housing is preferably provided with recesses to avoid contact between the housing and the image-bearing portions (e.g., frames) of the film. This can be achieved if the internal surface of the housing contacts the film only in the regions of the two flanges, i.e., along the marginal portions of the film. At least one of these marginal portions is normally provided with a row of perforations, and the engagement between the internal surface of the housing and the external surface of the film in the region or regions of the perforations cannot entail any damage to the image-bearing portions or frames of the film.

The stripping device can constitute an integral part of a housing section and can constitute a substantially wedge-like portion of the housing. Such wedge-like portion is preferably flanked by two mutually inclined surfaces which define an edge extending transversely of the convoluted film and adjacent to the inlet of the channel.

The apparatus can further comprise a plurality of (e.g., three) film-engaging idler rollers which are mounted in the housing between the rotating means and the inlet of the channel and serve to contact the outer side of the film in the chamber. The idler rollers are located downstream of the rotating means, as considered in the direction of unwinding of roll film from the reel at the unwinding station, and the idler rollers are positioned to contact the non-exposed portions of the film, e.g., the aforediscussed marginal portions which flank the exposed film frames.

The one mobile section of the housing can be disposed at a level below the channel and the housing can comprise a second mobile section which is disposed above the channel. In other words, the one mobile section can be located at a level below the roll of film at the unwinding station and the second mobile section can be disposed (at least in part) at a level above such roll of film.

The friction wheel of the rotating means is preferably provided with at least one circumferential groove and the housing is provided with an opening for the friction wheel and has a projection which extends into the groove. Means is provided for moving the friction wheel between a retracted position in which the friction wheel is out of contact with the roll of film in the chamber of the housing and an extended position in which the friction wheel engages and unwinds the film in the chamber. The projection of the housing preferably extends into the groove in the extended as well as in the retracted position of the friction wheel.

The apparatus can further comprise means (e.g., a driven roller) for engaging and entraining the leader of the film in response to movement of the one section of the housing to its inoperative position. Also, the apparatus can comprise or it can be associated with means for attaching the leaders of successively unwound films to the trailing ends of the previously unwound films in response to movement of the one section of the housing to the inoperative position.

The apparatus preferably further comprises means for intercepting an empty or nearly empty reel downstream of the outlet of the channel as soon as the reel leaves the chamber in response to opening of the housing, i.e., in response to pivoting or another movement of the mobile section or sections to the inoperative position(s). The channel is or can be substantially horizontal, and the intercepting means can include a ramp which slopes upwardly at an angle of approximately 45 degrees to the horizontal and is located in the path of movement of flanges on the oncoming reels. Means can be provided for severing the film adjacent to the intercepting means while the latter is engaged by the flanges of a reel. The one section of the housing is or can be closely adjacent to the severing means in the operative position of such section, and the outlet of the channel is preferably adjacent to the intercepting means. The means for actuating the severing means can receive a signal to initiate a severing operation in response to movement of the one housing section to its inoperative position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
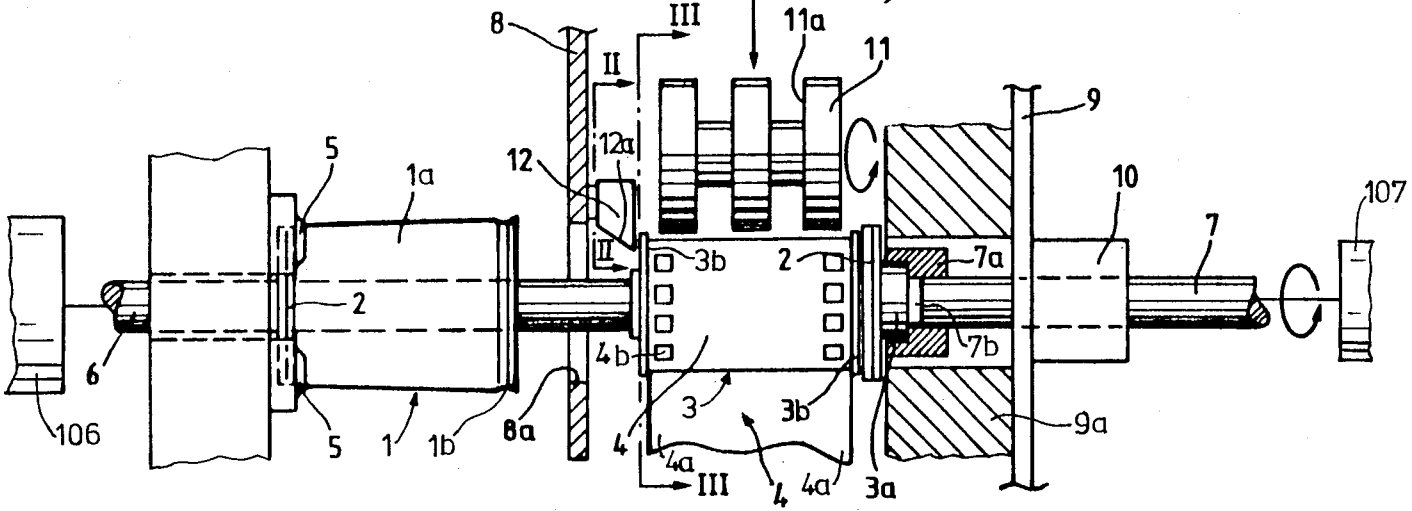
FIG. 1 is a horizontal sectional view of the apparatus, showing a reel at the unwinding station and the remainder of a container for roll film at the adjacent opening station.

FIG. 1 shows the shell 1*a* of a film cartridge or container 1 at an opening station 123 wherein the reels 3 with rolls of photographic film 4 thereon are expelled from the shells of successive containers and are transferred to an unwinding station 23 which is adjacent to the opening station 123. The core 3*a* of the expelled reel 3 has a longer end portion (at the right-hand side of the reel 3 which is shown in FIG. 1) and a shorter end portion. The reel 3 further comprises two spaced-apart disc-shaped flanges 3*b* which flank the marginal portions 4*a* of the convoluted roll film 4. Such marginal portions 4*a* are provided with rows of perforations 4*b*. Prior to expulsion of the reel 3, each container 1 further comprises two end walls 2 which are sealingly installed in the respective end portions of the shell 1*a* and are held against axial movement out of and away from the shell by circumferentially extending corrugations which are machined into the end portions of the shell. One such corrugation is shown at 1*b* in FIG. 1. The end walls 2 are held in the end portions of the shell 1*a* with a substantial force which must be overcome in order to move the reel 3 from the station 123 to the station 23 because such transfer of the reel involves expulsion of the right-hand end wall 2 from the corresponding end portion of the shell 1*a* and the advancement of the end wall through a circular opening 8*a* in a partition 8 forming part of a duct or other suitable means for supplying successive containers 1 to the opening station 123. The manner in which the containers 1 are supplied to the opening station 123 is preferably identical with the manner which is described and shown in the commonly owned copending patent application Ser. No. 778,609, filed 9-20-85 now U.S. Pat. No. 4,621,970. Each of the end walls 2 has a centrally located aperture which affords access to the respective end portion of the core 3*a*. As shown in FIG. 1, the right-hand end portion of the core 3*a* at the unwinding station 23 extends outwardly and beyond the respective end wall 2.

The apparatus comprises means for releasably supporting the core 3*a* of the reel 3 at the unwinding station 23. Such supporting means comprises an axially reciprocable rotary mandrel 7 and an axially reciprocable elongated pusher or transfer member 6. The pusher 6 can be shifted axially by a strong motor 106, preferably a fluid-operated (e.g., pneumatic) motor which can be said to constitute a means for disengaging the pusher 6 from the respective end portion of the core 3*a* at the station 23. The mandrel 7 is reciprocable by a weaker fluid-operated (preferably pneumatic) motor 107 which constitutes a means for disengaging the mandrel from the respective end portion of the core 3*a* at the unwinding station 23. When the pusher 6 is caused to perform an axial movement in a direction to the right, as viewed in FIG. 1, so as to assume the extended position which is shown in this Figure, it expels the right-hand end wall 2 and the entire reel 3 from the shell 1*a* while the shell is grasped by the grippers 5 of a holder of the type fully described in the aforementioned copending patent application Ser. No. 778,609, filed 9-20-85 now U.S. Pat. No. 4,621,970. The grippers 5 ensure that the shell 1*a* is held at the opening station 123 without excessive deformation but with a force which is amply sufficient to enable the pusher 6 to segregate the front or right-hand end wall 2 from such shell and to advance the expelled end wall 2 as well as the entire reel 3 and the roll of film 4 thereon from the station 123 to the station 23. The holder can comprise at least four equidistant grippers 5 in the form of idler rollers with sharp circumferentially extending edges.

The left-hand end portion of the mandrel 7 has a blade-like torque-transmitting projection 7*b* which can penetrate into the adjacent hollow end portion of the core 3*a* and to engage one or more internal ribs or webs (FIGS. 3–5) so that the reel 3 can be rotated in a direction to wind up the film 4 during transfer from the opening station 123 to the unwinding station 23. The left-hand end portion of the mandrel 7 further carries a centering sleeve 7*a* which can receive the adjacent end portion of the core 3*a* to thus ensure that the entire reel 3 is properly centered with reference to the opening 8*a* during transfer of the reel from the interior of the shell 1*a* (while such shell is held by the grippers 5) into the space between the partition 8 and an upright wall 9 of the frame or casing of the improved apparatus. The means for rotating the mandrel 7 can comprise an elongated pinion on the mandrel and a driven gear which is in mesh with the pinion in each of every axial position of the mandrel.

Figure 3:
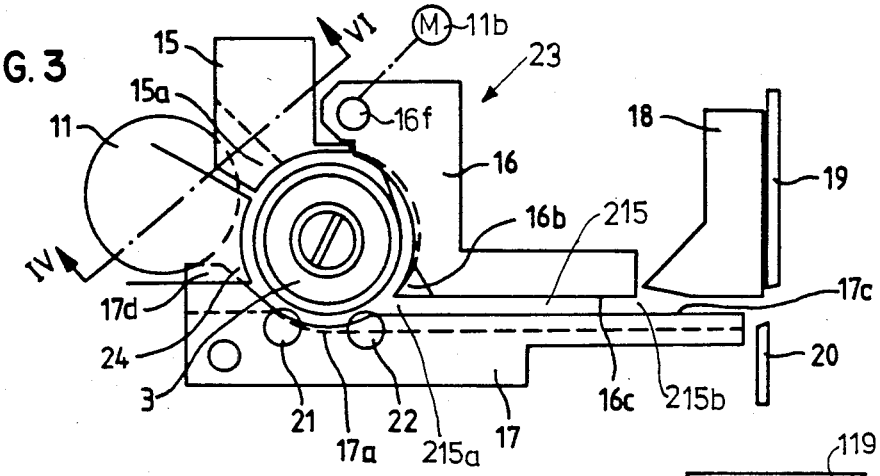
FIG. 3 is a sectional view as seen in the direction of arrows from the line III—III of FIG. 1 and shows the composite housing in closed position.
Figure 4:
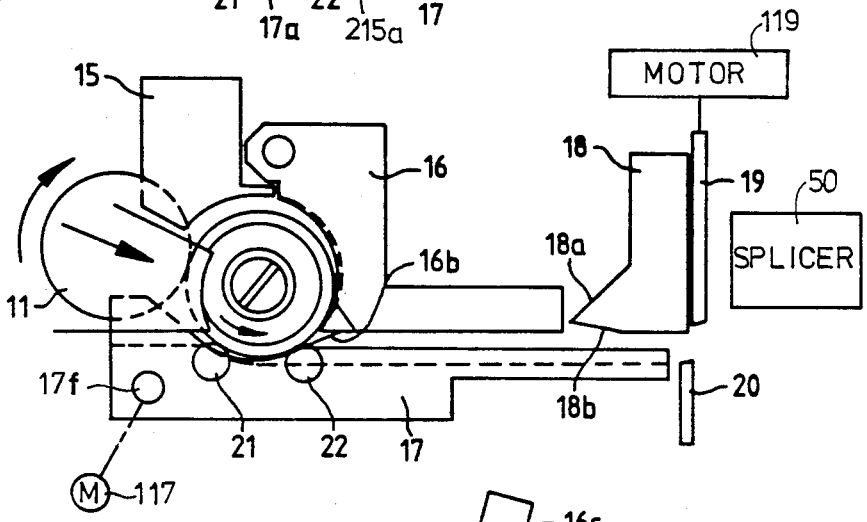
FIG. 4 is a similar view but shows another stage of treatment of roll film at the unwinding station.
Figure 5:
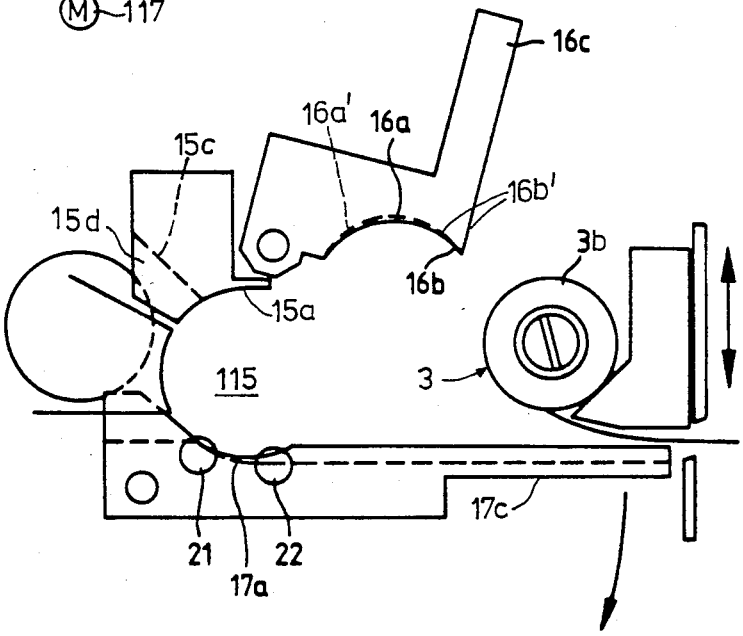
FIG. 5 is a similar view but shows the housing in open position and the empty reel in engagement with the intercepting means.

The mandrel 7 cooperates with the pusher 6 to hold and support the reel 3 during transfer from the opening station 123 to the unwinding station 23. To this end, the motor 107 moves the mandrel 7 in a direction to the left, as viewed in FIG. 1, before the pusher 6 is caused to perform a rightward stroke so that the end portion 7*b* of the mandrel 7 can start to rotate the reel 3 while the latter is still located within the confines of the shell 1*a*. The motors 106 and 107 are actuated to retract or disengage the pusher 6 and the mandrel 7 from the respective end portions of the core 3*a* at the unwinding station 23 as soon as the reel 3 is properly confined in the chamber 115 of a composite housing the details of which are shown in FIGS. 3, 4 and 5. The arrangement may be such that the mandrel 7 causes the reel 3 to complete approximately three revolutions during transfer of the core 3*a* from the interior of the shell 1*a* at the station 123 to the station 23.

Figure 2:
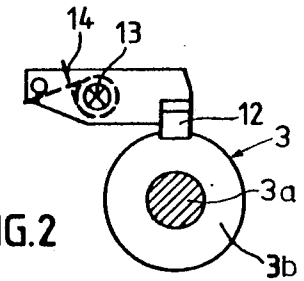
FIG. 2 is a sectional view as seen in the direction of arrows from the line II—II of FIG. 1.

The housing at the station 23 comprises a fixed or stationary section 15, a first mobile section 16, and a second mobile section 17. When the housing is closed, namely when the mobile sections 16 and 17 are held in the operative positions shown in FIG. 4, the sections 15, 16 and 17 completely surround the outermost convolution of the film 4 between the flanges 3*b* of the reel 3. The axial length of the housing at most matches the distance between the flanges 3*b*. In the embodiment which is shown in FIGS. 3 to 5, the sections 16 and 17 are pivotable (at 16*f* and 17*f*) with reference to the stationary section 15 under the action of discrete moving means 116 and 117 each of which can constitute a reversible electric motor, an electromagnet or a fluid-operated motor of any suitable design. The core 3 and the roll of film 4 thereon can be readily introduced into the chamber 115 of the housing while the sections 16 and 17 are held in the inoperative or retracted positions (see the retracted position of the housing section 16 in FIG. 5) because the core 3 is driven in a direction to wind the film 4 onto its core 3*a* even before the pusher 6 begins to expel the core from the interior of the shell 1*a* at the opening station 123. This also enables the reel 3 and the roll of film 4 thereon to readily pass through the opening 8*a* of the partition 8 which forms part of a duct, i.e., of the means for supplying successive containers 1 to the opening station 123. The center of the opening 8*a* in the partition 8 is located on the common axis of the mandrel 7 and pusher 6. The diameter of the opening 8*a* is only slightly larger than the outer diameter of the reel 3. The surface surrounding the opening 8*a* prevents a clockspringing of the convoluted roll of film 4 during passage of the reel 3 through the partition 8. The means for preventing unwinding of the film 4 before the respective reel 3 reaches the unwinding station 23 further comprises a lever 12 which is pivotably mounted at 13 in the housing of the apparatus (for example, on the partition 8) by a pin 13 and is biased in a clockwise direction, as viewed in FIG. 2, by a torsion spring 14. The downwardly sloping underside or bottom surface 12*a* of the lever 12 rides first over the expelled end wall 2, thereupon over the front flange 3*b*, thereupon over the outermost convolution of the film 4 between the flanges 3*b*, and finally over the trailing flange 3*b* before it descends to the position of FIG. 1 in which it prevents the reel 3 from sharing the leftward movement of the pusher 6 when the motor 106 is actuated to separate the pusher from the reel at the unwinding station 23. The apparatus can comprise two or more spring-biased levers 12 or analogous means for preventing premature unwinding of the film 4, and the illustrated lever 12 can be mounted in a different position, i.e., wherever there is sufficient room for such lever at the unwinding station 23.

The mandrel 7 is mounted in a stationary bearing 10 which is supported by the wall 9 of the improved apparatus. The aforedescribed gear and pinion for rotating the mandrel 7 can be replaced with other suitable rotating means without departing from the spirit of the invention. All that counts is to ensure that the mandrel 7 can be rotated about its own axis and that the mandrel can also move axially toward and away from the extended position of FIG. 1 in which its end portion 7*b* engages and transmits torque to the core 3*a* of the reel 3 at the unwinding station 23. The motor 107 for the mandrel 7 is weaker than the motor 106 for the pusher 6 so that the pusher can overcome the resistance of the motor 107 and can push the mandrel 7 in a direction to the right, as viewed in FIG. 1, to the illustrated position with attendant transfer of the reel 3 from the interior of the shell 1*a* at the opening station 123, through the opening 8*a* of the partition 8 and to the unwinding station 23 where the roll of film 4 on such reel enters the chamber 115. The wall 9 further carries a sleeve 9*a* whose inner diameter exceeds the outer diameter of the centering portion 7*a* of the mandrel 7 but is smaller than the diameter of the expelled wall 2 so that such wall cannot penetrate into the interior of the sleeve 9*a*.

The means for rotating the roll of film 4 at the station 23 in a direction to unwind the film from the reel 3 comprises a friction wheel 11 which is movable by a suitable motor 111 toward and away from engagement with the outermost convolution of the film in the chamber 115. To this end, the stationary section 15 of the housing at the station 23 is formed with an opening 15*c* which permits movements of the friction wheel 11 into and from engagement with the film at the station 23. The friction wheel 11 has one or more circumferential grooves 11*a* which receive complementary projections 15*d* of the stationary housing section 15 in each (retracted or extended) position of the friction wheel with reference to the housing. The bearings for the end portions of the friction wheel 11 are not specifically shown in the drawing. Such bearings can be reciprocated by the moving means 111 substantially radially of the roll of film 4 in the chamber 115 which is defined by the sections 15, 16 and 17 of the housing at the unwinding station 23. The section 15 has recesses or grooves 15*b* for the larger diameter portions of the friction wheel 11.

The internal surface of the housing is composed of a concave internal surface 15*a* of the stationary housing section 15, a concave internal surface 16*a* of the mobile section 16, and a concave internal surface 17*a* of the mobile section 17. Such sections are preferably formed with recesses (see the broken line 16*a'* in FIG. 5 which denotes the recess in the concave surface 16*a*) in order to ensure that the respective internal surfaces contact only selected portions of the exterior of the film 4, namely those portions which do not carry exposed film frames. For example, the configuration of recesses in the internal surfaces 15*a*, 16*a* and 17*a* can be such that these internal surfaces contact only the marginal portions 4*a* of the film 4, namely the film portions in the regions which are provided with perforations 4*b* of the type shown in FIG. 1. This ensures that confinement of the film 4 in the chamber 115 during unwinding does not adversely affect the quality of the emulsion on the exposed portions of the film.

The mobile housing section 16 is provided with an elongated extension 16*c* which flanks the upper side of an elongated channel 215. Such channel is further defined by an extension 17*c* of the other mobile housing section 17. The inlet 215*a* of the channel 215 communicates with the chamber 115 and serves to receive the leader of the film 4 when the friction wheel 11 is operative to rotate the film in the chamber 115 in a counterclockwise direction, as viewed in FIG. 4.

The housing, and more specifically the mobile housing section 16, is further provided with a wedge-like projection 16*b* which constitutes a stripping device and is flanked by two mutually inclined surfaces 16*b'* defining a relatively sharp edge which is closely adjacent to the inlet 215*a* of the channel 215 and serves to ensure the penetration of the leader of film 4 into the channel in response to counterclockwise rotation of the film 4. It will be noted that the pivot 16*f* for the section 16 is located at a level above the chamber 115, and that the pivot 17*f* for the mobile section 17 is located at a level below the friction wheel 11 when the latter is held in the operative position of FIG. 4.

The section 17 of the housing further supports idler rollers 21 and 22 which are disposed between the friction wheel 11 and the stripping device 16*b* and engage the outer side of the outermost convolution of the film 4 in order to advance such convolution toward engagement with the stripping device 16*b*. The idler rollers 21 and 22 are located downstream of the friction wheel 11, as considered in the direction of advancement of the film during unwinding, and they preferably engage the marginal portions 4*a* of the film, namely those portions which do not carry exposed images. The purpose of the idler rollers 21 and 22 is to reduce friction between the leader of the film 4 and the adjacent portion of the housing section 17 during the initial stage of unwinding, namely before the leader reaches and is diverted by the edge of the stripping device 16*b*.

Figure 6:
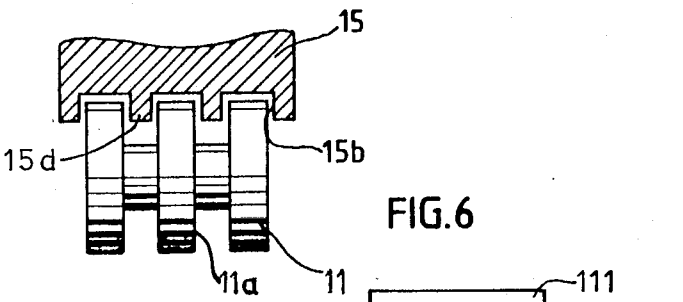
FIG. 6 is a sectional view as seen in the direction of arrows from the line VI—VI of FIG. 3.

FIG. 6 shows that the stationary housing section 15 includes a substantially comb-like portion with several projections 15*d* which extend into the neighboring circumferential grooves 11*a* of the friction wheel 11. Similar projections or teeth (shown at 17*c* in FIG. 3) are provided on the leftmost portion of the mobile housing section 17 to enter into the adjacent grooves 11*a* of the friction wheel 11, at least when the friction wheel is held in the operative position so that its peripheral surface is in egagement with the outer side of the outermost convolution of the film 4 in the chamber 115.

FIG. 3 further shows an arcuate shroud 24 which is arranged to share the reciprocatory movements of the friction wheel 11 under the action of the moving means 111. The purpose of the shroud 24 is to prevent a return axial movement of the reel 3 from the unwinding station 23 toward the opening 8*a* of the partition 8. In other words, such shroud assists the lever 12 in preventing the left-hand flange 3*b* of the reel 3 at unwinding station 23 of FIG. 1 from moving back towards the shell 1*a*.

The channel 215 which is defined by the sections 16 and 17 in the operative positions of such sections is relatively narrow so as to ensure predictable advancement of successive increments of the film 4 toward and into the range of a severing unit including a fixed knife 20 and a vertically reciprocable knife 19. The means for actuating the severing means includes a drive 119 which can move the knife 19 up and down, namely toward and away from the stationary knife 20. The upper knife 19 is movably mounted on a bearing 18 which includes a ramp 18*a* with an upwardly sloping surface and a downwardly sloping surface 18*b*. The ramp 18*a* serves as a means for intercepting the empty or nearly empty reel 3 when the housing including the sections 15, 16 and 17 is opened in a manner as shown in FIG. 5 so that the reel 3 can advance along the upper side of the extension 17*c* of the section 17*a* and its flanges 3*b* strike against the upwardly inclined surface which preferably makes an angle of about 45° with the horizontal. The extension 17*c* of the housing section 17 preferably extends close to the cutting edge of the stationary knife 20.

FIG. 3 shows the position of the reel 3 at the unwinding station 23 during introduction of the leader of the film 4 into the inlet 215*a* of the channel 215. FIG. 4 shows the parts at the unwinding station 23 during a further stage of operation when a substantial part of the film 4 is already advanced through and beyond the gap between the knifes 19 and 20 and onto a splicer 50 which comprises a roller or other means for drawing the film from the chamber 115. The outlet 215*b* of the channel 215 is adjacent to the tip of the intercepting means 18*a*.

The mode of operation of the apparatus is as follows:

The downwardly sloping duct including the partition 8 delivers a container 1 to the opening station 123 where the shell 1*a* of such container is engaged by the grippers 5. The core 3*a* in the container 1 is rotated by the mandrel 7 in a direction to wind the film 4 onto the reel 3 in the interior of the shell 1*a*. In the next step, the motor 106 starts the pusher 6 so that the pusher is moved in a direction to the right, as viewed in FIG. 1, with a substantial force which suffices to ensure that the reel 3 in the shell 1*a* expels the right-hand end wall 2 from such shell and propels the expelled end wall 2 as well as the reel 3 with the convoluted film 4 thereon through the opening 8*a* of the partition 8 and into the unwinding station 23. Unwinding of the film 4 is prevented because the mandrel 7 rotates in a direction to wind the film 4 onto the reel 3 as well as by the lever 12 which operates in the aforedescribed manner to bear first upon the removed end wall 2, thereupon upon the righthand flange 3*b*, thereupon on the outermost convolution of the film 4 on the core 3*a* between the flanges 3*b* and thereupon on the trailing flange 3*b* before it assumes the position which is shown in FIG. 1 and in which the lever 12 prevents a return movement of the reel 3 in a direction from the station 23 toward the opening 8*a*.

The sections 15, 16 and 17 of the housing assume the positions which are shown in FIG. 3 while the reel 3 moves from the station 123 toward the station 23. At such time, the sections 15, 16 and 17 provide adequate room for introduction of the reel 3 into the chamber 115. The movements of the friction wheel 11 and shroud 24 under the action of the moving means 111 and the movements of the disengaging means 106, 107 for the pusher 6 and mandrel 7 are synchronized in such a way that the parts 6 and 7 are disengaged from the core 3*a* not later than when the reel 3 assumes the position which is shown in FIGS. 3 and 4 so that the film 4 is located in the housing 15, 16, 17 within the confines of the chamber 115. This ensures that, as a result of disengagement of the parts 6 and 7 from the core 3*a*, the reel 3 is free to move radially within the confines of the chamber 115. The moving means 111 shifts the friction wheel 11 in parallelism with the latter's axis at right angles to the axis of the core 3*a* at the station 23 so that the reel 3 and the film 4 are urged tangentially against the stripping device 16*b* of the mobile housing section 16. The moving means 111 drives the friction wheel 11 in a clockwise direction, as viewed in FIG. 4, whereby the reel 3 is driven in a counterclockwise direction and the leader of the film 4 advances toward the stripping device 16*b* to be introduced into the inlet 215*a* of the channel 215 and to advance toward and beyond the outlet 215*b*. The arrangement is preferably such that the film 4 completes at least two full revolutions while its leader advances past the stripping device 16*b*. This ensures that, if the stripping device 16*b* fails to divert the leader into the channel 215 during the first revolution of the film 4, such diversion is invariably effected during the second, or at the very most, third revolution of the film. The apparatus preferably comprises a sensor which is located adjacent to the channel 215 close to the inlet 215*a* and the stripping device 16*b* and generates a signal to reverse the direction of rotation of the friction wheel 11 if the sensor fails to detect the leader of the film 4 in the channel 215. The friction wheel 11 is thereupon again rotated in a clockwise direction, as viewed in FIG. 4, in order to ensure that the leader of the film 4 is again advanced past the stripping device 16*b* which ensures that the leader enters the inlet 215*a* of the channel 215. It is also possible to repeat, for the third time, the introduction of the leader of the film 4 into the channel 215. Since the projections 15*d* of the housing section 15 extend into the grooves 11*a* of the friction wheel 11 and the projections 17*c* of the movable housing section 17 extend into the same grooves 11*a*, the housing including the sections 15, 16 and 17 confines the roll of film 4 in the chamber 115 in such a way that a bypassing of the inlet 215*a* of the channel 215 by the leader of the film is practically impossible, especially if the attempt to introduce such leader into the channel 215 is repeated for a second or a third time. It has been found that, in actual practice, the leader of the film 4 enters the channel 215 during the first revolution of the film in the chamber 115 and not later than during the second revolution. The feature that the attempt to introduce the leader of the film 4 into the channel 215 is repeated for the second or third time invariably ensures that the leader advances along the path which is defined by the extensions 16*c*, 17*c* of the housing sections 16 and 17 toward and into the range of the severing means including the knives 18 and 19.

Once the leader of the film 4 has entered the inlet 215*a* of the channel 215, the friction wheel 11 cooperates with the idler rollers 21 and 22 to advance the leader through the channel 215, beyond the outlet 215*b* and into the range of the advancing roller or rollers which form part of the splicer 50. The roller or rollers of the splicer 50 can define one or more nips through which the leader of the film 4 advances toward the splicing station. For example, the splicer 50 can comprise a pair of advancing rolls which advance the film along a further path (defined by an elongated channel or the like) and on toward the splicing station wherein the leader of the film is attached to the trailing end of the preceding film by one or more strips of adhesive or the like. The purpose of the knives 19 and 20 is to cut transversely across the normally uneven leader of the film 4 so that the leader of the film is in proper position and has an optimum configuration for attachment to the trailing end of the preceding film. As a rule, the leader of the film 4 will have a narrow forwardly extending tongue which is removed by the knives 19 and 20 so that a full width of the film 4 is ready for splicing to the trailing portion of the preceding film. The preceding film and the freshly attached film are convoluted onto a suitable core to form parts of a relatively long web or strip which is ready for introduction into the developing machine before the developed strip or web is introduced into a copying machine.

The section 16 of the housing at the unwinding station 23 is pivoted to its retracted or inoperative position practically immediately upon engagement of the leader of the film 4 by the roller or rollers of the splicer 50. For example, the section 16 can be held in its operative position by a detent pawl, not shown, which is disengaged as soon as the leader of the film 4 reaches the advancing roll or rolls at the station accommodating the splicer 50. The reel 3 is thereupon withdrawn from the chamber 115 due to the entraining action of the roller or rollers at the splicing station whereby the reel, and more particularly its flanges 3*b*, comes into engagement with the upper surface of the wedge-like intercepting device 18*a* forming part of the bearing 18. At such time, the unwinding of the film 4 can proceed at a very high speed. Since the intercepting device 18*a* contacts only the flanges 3*b*, the film 4 itself does not come into contact with the bearing 18 or with any other part; this ensures that the film is not damaged or otherwise adversely affected by rapid unwinding from the core 3*a* of the reel 3 which is being held by the intercepting device 18*a*. The inclination of the surface 18*b* at the underside of the intercepting device 18*a* is such that it cannot come into direct contact with successive increments of the rapidly advancing film 4.

As soon as the film 4 is completely unwound from the core 3*a* of the reel 3, the trailing portion of the film is tensioned abruptly and the tensional stress in such portion increases substantially. A sensor, not shown, monitors the tension in the trailing portion of the film 4 and actuates the means 119 for reciprocating the knife 19 so that the severing device 19, 20 rapidly severs the film 4 in a region which is immediately adjacent to the core 3*a* of the respective reel 3. This ensures that the film is not severed in the region of an exposed film frame but rather in a portion which is located behind the rearmost exposed frame. The thus separated trailing end of the film 4 continues to advance toward the splicer 50 where it is detected and attached to the leading end of the next-following film as soon as the leader of such next-following film reaches the splicing station. In the next step, the section 17 of the housing is pivoted downwardly in a clockwise direction, as viewed in FIG. 5, so as to permit the empty reel 3 and the remnant of the film 4 thereon to descend into a suitable intercepting receptacle which is not shown in the drawing.

The mandrel 7 can be returned to the position of FIG. 1 and beyond such position even before the unwinding of the film 4 from the reel 3 is completed, i.e., as soon as the reel 3 reaches and is held by the intercepting device 18*a*. This contributes to a higher output of the improved apparatus because the next-following reel 3 can be properly engaged between the mandrel 7 and the pusher 6 while the remnant of the film 4 is still being unwound from the reel 3 whose flanges 3*b* abut against the upper side of the intercepting device 18*a*. It has been found that the improved apparatus can process a substantially larger number of reels 3 per unit of time than any heretofore known processing apparatus.

The sections 16 and 17 of the housing are returned to the positions of FIG. 3 immediately after the reel 3 whose flanges 3*b* abut against the upper side of the intercepting device has been permitted to descend into the aforementioned receptacle. The chamber 115 is then ready to receive the next reel 3 with a convoluted roll of film thereon, and such film is then processed (unwound) in the same way as described above. The friction wheel 11 is held in the retracted or inoperative position while a fresh reel is being transferred from the opening station 123 to the unwinding station 23.

An important advantage of the improved apparatus is that the mandrel 7 and the pusher 6 can be caused to engage the core 3*a* of a fresh reel 3 before the preceding reel is relieved of the film 4 thereon. This is due to the fact that the reel 3 which is introduced into the chamber 115 need not be held by the parts 6 and 7 because such reel 3 is properly confined by the sections 15, 16 and 17 of the housing at the unwinding station 23. The unwinding is effected by the friction wheel 11 which can be moved into engagement with the outermost convolution of the film 4 at the station 23 as soon as the film is properly confined by the sections 15, 16 and 17 of the housing. The feature that the length of the housing sections 15, 16 and 17 need not exceed the distance between the flanges 3*b* of a reel 3 at the station 23 ensures that the housing sections can properly confine the film 4 even if the core 3*a* of the respective reel 3 is released by the pusher 6 and the mandrel 7 before the unwinding of the film begins. This applies irrespective of the diameter of the roll of film 4 on the core 3 and irrespective of the exact nature of the containers 1 which are being processed in the apparatus of the present invention. It is further immateral whether the films 4 are short, medium long or long, i.e., whether each such film contains 12, 24 or 36 frames.

Rapid retraction of the mandrel 7 and pusher 6 from engagement with the core 3*a* at the unwinding station 23 renders it possible to ensure that such parts engage the next-following core 3*a* during unwinding of film from the core which is located at the station 23. This contributes significantly to the output of the improved apparatus. The next core 3*a* is held in a position of readiness at the opening station 123 prior to completion of unwinding of film 4 from the core 3 which is located at the unwinding station 23.

A splicer to splice the films which are unwound in the described manner may be of the type the described in U.S. Pat. No. 4,080,242 of the assignee.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for unwinding photographic roll films from successive reels of the type wherein a roll of film is convoluted around a core between two spaced-apart flanges, comprising means for releasably supporting the cores of successive reels in a predetermined orientation at an unwinding station; means for disengaging the supporting means from the core of the reel at said station; a housing provided at said station and comprising a plurality of sections including at least one mobile section and means for moving said one section between an operative position in which said sections define a chamber for the roll of film on the core of the reel at said station and a channel having an inlet in communication with said chamber, and an inoperative position in which the reel can be removed from the housing, the length of said chamber, as considered in the axial direction of the reel at said station, being less than the distance between the flanges of a reel; and means for rotating the roll of film at said station in the operative position of said one section in a direction to unwind the film and to cause entry of the leader of the film into said channel.

2. The apparatus of claim 1, wherein said housing includes a stripping device which is adjacent to the inlet of said channel and is arranged to direct the leader of the film in said chamber into said channel in response to rotation of the film in said chamber in a direction to unwind the film from the core, said rotating means and said stripping device being disposed substantially diametrically opposite each other with reference to the roll of film in said chamber.

3. The apparatus of claim 2, wherein said disengaging means is actuatable to disengage the supporting means from the core of the reel at said station prior to unwinding of the film from the core by said rotating means.

4. The apparatus of claim 2, wherein said housing has an internal surface which is adjacent to the external surface of the roll of film in said chamber and has recesses to avoid contact between the housing and the image-bearing portions of the film.

5. The apparatus of claim 4, wherein said internal surface contacts the external surface of the film in immediate proximity of the flanges of the respective reel.

6. The apparatus of claim 2, wherein said stripping device includes a substantially wedge-like portion of said housing, said wedge-like portion being flanked by two mutually inclined surfaces defining an edge adjacent to the inlet of said channel.

7. The apparatus of claim 2, wherein said one section is disposed at a level above the roll of film at said station and said housing further includes a second mobile section which is disposed at a level below the film at said station.

8. The apparatus of claim 2, further comprising means for engaging and entraining the leader of the film in response to movement of said one section to said inoperative position.

9. The apparatus of claim 8, wherein said entraining means comprises a roller which is adjacent to said channel.

10. The apparatus of claim 2, further comprising means for attaching the leaders of successively unwound films to the trailing ends of the previously unwound films in response to movement of said one section to said inoperative position.

11. Apparatus for unwinding photographic roll films from successive reels of the type wherein a roll of film is convoluted around a core between two spaced-apart flanges, comprising means for releasably supporting the cores of successive reels in a predetermined orientation at an unwinding station; means for disengaging the supporting means from the core of the reel at said station; a housing provided at said station and comprising a plurality of sections including at least one mobile section and means for moving said one section between an operative position in which said sections define a chamber for the roll of film on the core of the reel at said station and a channel having an inlet in communication with said chamber, and an inoperative position in which the reel can be removed from the housing; and means for rotating the roll of film at said station in the operative position of said one section in a direction to unwind the film and to cause entry of the leader of the film into said channel, said housing including a stripping device which is adjacent to the inlet of said channel and is arranged to direct the leader of the film in said chamber into said channel in response to rotation of the film in said chamber in direction to unwind the film from the core, said rotating means and said stripping device being disposed substantially diametrically opposite each other with reference to the roll of film in said chamber, and further comprising a plurality of film-engaging idler rollers provided in said housing between said rotating means and the inlet of said channel and arranged to contact the outer side of the roll of film in said chamber.

12. The apparatus of claim 11 for unwinding exposed photographic films, wherein said rollers are located downstream of the rotating means as considered in the direction of unwinding of roll film and are arranged to contact the non-exposed portions of the film.

13. The apparatus of claim 12 for unwinding exposed photographic films of the type having two marginal portions at least one of which is provided with a row of perforations, wherein said rollers are arranged to engage the film in the region of at least one of the marginal portions of such film.

14. Apparatus for unwinding photographic roll films from successive reels of the type wherein a roll of film is convoluted around a core between two spaced-apart flanges, comprising means for releasably supporting the cores of successive reels in a predetermined orientation at an unwinding station; means for disengaging the supporting means from the core of the reel at said station; a housing provided at said station and comprising a plurality of sections including at least one mobile section and means for moving said one section between an operative position in which said sections define a chamber for the roll of film on the core of the reel at said station and a channel having an inlet in communication with said chamber, and an inoperative position in which the reel can be removed from the housing; and means for rotating the roll of film at said station in the operative position of said one section in a direction to unwind the film and to cause entry of the leader of the film into said channel, said housing including a stripping device which is adjacent to the inlet of said channel and is arranged to direct the leader of the film in said chamber into said channel in response to rotation of the film in said chamber in a direction to unwind the film from the core, said rotating means and said stripping device being disposed substantially diametrically opposite each other with reference to the roll of film in said chamber, said rotating means comprising a friction wheel having at least one circumferential groove and said housing having an opening for said friction wheel as well as at least one projection extending into said groove.

15. The apparatus of claim 14, further comprising means for moving said friction wheel between a retracted position in which the friction wheel is out of contact with the film in said chamber and an extended position in which the friction wheel engages and unwinds the film in said chamber, said projection extending into said groove in the extended as well as in the retracted positions of said wheel.

16. Apparatus for unwinding photographic roll films from successive reels of the type wherein a roll of film is convoluted around a core between two spaced-apart flanges, comprising means for releasably supporting the cores of successive reels in a predetermined orientation at an unwinding station; means for disengaging the supporting means from the core of the reel at said station; a housing provided at said station and comprising a plurality of sections including at least one mobile section and means for moving said one section between an operative position in which said sections defined a chamber for the roll of film on the core of the reel at said station and a channel having an inlet in communication with said chamber and an outlet, and an inoperative position in which the reel can be removed from the housing; means for intercepting the reel downstream of said outlet following the movement of the reel from said chamber as a result of movement of said one section to said inoperative position; and means for rotating the roll of film at said station in the operative position of said one section in a direction to unwind the film and to cause entry of the leader of the film into said channel, said housing including a stripping device which is adjacent to the inlet of said channel and is arranged to direct the leader of the film in said chamber into said channel in response to rotation of the film in said chamber in a direction to unwind the film from the core, said rotating means and said stripping device being disposed substantially diametrically opposite each other with reference to the roll of film in said chamber.

17. The apparatus of claim 16, wherein said channel is substantially horizontal and said intercepting means includes a ramp having a side slopes upwardly at an angle of approximately 45 degrees.

18. The apparatus of claim 17, wherein said ramp is positioned to be engaged by the flanges of the oncoming reels.

19. The apparatus of claim 16, further comprising means for severing the film adjacent to said intercepting means while the latter is engaged by a reel.

20. The apparatus of claim 19, wherein said one section of said housing is closely adjacent to said severing means in the operative position of said one section and said channel has an outlet adjacent to said intercepting means.

21. The apparatus of claim 19, further comprising means for actuating said severing means in response to movement of said one section to said inoperative position.

* * * * *